US011103912B2

(12) United States Patent
Meneghetti

(10) Patent No.: US 11,103,912 B2
(45) Date of Patent: Aug. 31, 2021

(54) PUNCHING APPARATUS

(71) Applicant: SALVAGNINI ITALIA S.P.A., Sarego (IT)

(72) Inventor: Nicola Meneghetti, Villaga (IT)

(73) Assignee: SALVAGNINI ITALIA S.P.A., Sarego (IT)

( * ) Notice: Subject to any disclaimer, the term of this patent is extended or adjusted under 35 U.S.C. 154(b) by 393 days.

(21) Appl. No.: 16/173,259

(22) Filed: Oct. 29, 2018

(65) Prior Publication Data

US 2019/0060974 A1 Feb. 28, 2019

Related U.S. Application Data

(62) Division of application No. 14/893,110, filed as application No. PCT/IB2014/061630 on May 22, 2014, now Pat. No. 10,144,046.

(30) Foreign Application Priority Data

May 27, 2013 (IT) ..... MO2013A000148
May 27, 2013 (IT) ..... MO2013A000149

(51) Int. Cl.
*B21D 28/24* (2006.01)
*B21D 28/12* (2006.01)

(52) U.S. Cl.
CPC ..... *B21D 28/24* (2013.01); *B21D 28/125* (2013.01); *B21D 28/246* (2013.01)

(58) Field of Classification Search
CPC ..... B21D 28/12; B21D 28/125; B21D 28/24; B21D 28/246; B21D 28/26; B21D 37/04
See application file for complete search history.

(56) References Cited

U.S. PATENT DOCUMENTS 5,012,712 A 5/1991 Nordquist
5,048,385 A 9/1991 Eckert et al.
(Continued)

FOREIGN PATENT DOCUMENTS

CN 101035637 9/2007
EP 0 875 310 11/1998
(Continued)

OTHER PUBLICATIONS

International Search Report dated May 12, 2014 in International (PCT) Application No. PCT/IB2014/061630.
(Continued)

*Primary Examiner* — Teresa M Ekiert
(74) *Attorney, Agent, or Firm* — Wenderoth, Lind & Ponack, L.L.P.

(57) ABSTRACT

A punching apparatus includes a beating element that is arranged for interacting with at least one punching tool and is movable inside a container along and around a work axis, a first rotating actuator coupled to the beating element to move it linearly along the work axis between internal and external operating positions and drive the punching tool, and a second rotating actuator connected to the beating element and arranged for rotating it around the work axis, in particular for angularly orienting the punching tool. The second rotating actuator comprises a second electric motor having a stator fixed to the container and a rotor that is internal to the stator and connected to the beating element to rotate it. The rotor extends along the work axis to face, and be engaged with, the stator between the operating positions.

13 Claims, 4 Drawing Sheets

(56) References Cited

U.S. PATENT DOCUMENTS

| | | | | |
|---|---|---|---|---|
| 6,074,330 | A | 6/2000 | Ostini | |
| 8,001,877 | B2 | 8/2011 | Schmidt et al. | |
| 2001/0025556 | A1 | 10/2001 | Ostini | |
| 2004/0154453 | A1 | 8/2004 | Kobayashi | |
| 2007/0101840 | A1 | 5/2007 | Schumauder | |
| 2007/0240551 | A1 | 10/2007 | Erlenmaier | |
| 2009/0013843 | A1 | 1/2009 | Schmauder | |
| 2009/0211326 | A1* | 8/2009 | Laib | B21D 28/24 72/332 |
| 2011/0107888 | A1* | 5/2011 | Thielges | B21D 28/125 83/139 |
| 2011/0120281 | A1 | 5/2011 | Schmauder | |

FOREIGN PATENT DOCUMENTS

| | | |
|---|---|---|
| EP | 1 057 551 | 12/2000 |
| EP | 1 138 411 | 10/2001 |
| JP | 7-265971 | 10/1995 |
| JP | 2004-237323 | 8/2004 |
| JP | 2005-500180 | 1/2008 |
| JP | 2008-500178 | 1/2008 |

OTHER PUBLICATIONS

Italian Search Report dated Jan. 20, 2014 in Italian Patent Application No. MO2013A000149.

Japanese Office Action dated Mar. 19, 2018 in corresponding Japanese Patent Application No. 2016-516269 with English translation.

* cited by examiner

1

15
A
4
3
10
31
11
12
5
13
51
R
52
16
6
20
B
2
22
9
8
30
19
20
21
36
35
C
30

PUNCHING APPARATUS

The invention relates to machine tools for machining metal workpieces and/or sheets and in particular it relates to a punching apparatus installable on a punching machine for performing cutting and punching operations.

The known punching machines comprise a punching apparatus, so called punch head, which supports and moves along a work axis a punching tool that acts upon the workpiece, typically a sheet metal, cooperating with a below punch die or counterpunch. The die is generally fixed to a work table of the punching machine which supports the workpiece to be machined.

In punch heads with a single tool, the latter is removably mounted on a support element, so called spindle, which is driven linearly along and in rotation around the work axis by respective actuators. The linear movement along the work axis in the two opposite directions enables work and return strokes of the tool during the punching process. The rotation movement around the work axis enables the punching tool to rotate and its angular orientation (indexing) to be modified in order to perform different cutting or punching operations on the workpiece to be machined.

Two distinct actuators are used to move the spindle that supports the tool linearly and in rotation, respectively. The actuators can be hydraulic or electric. In the latter case, the actuators comprise rotary electric motors which are positioned at the sides of the spindle and act on the latter by respective transmission means. In particular, a first electric motor acts on a screw-nut screw device which converts the rotation imparted by the first motor into a translation movement for the spindle. A second electric motor acts, for example by spline coupling joint, on the spindle so as to transmit the necessary rotation to the latter. The arrangement of the two electric motors at the sides of the spindle renders the punch head particularly bulky.

In multi-tool punch heads there is provided a beating element, so called ram, which is moved linearly along the work axis and acts on the selected tool, imparting to the latter the kinetic energy and linear movement necessary for performing the machining <operation on the workpiece.

The punching tools are housed in a tool holding device fixed to the punch head and positioned between the ram and the workpiece to be machined. The tool holding device generally comprises a revolving drum in which the tools are slidably housed, that are arranged circumferentially around the drum rotation axis.

The punch head can be further provided with a tool holding turret on which a plurality of tool holding devices is mounted. The tool holding turret can be rotated around a respective rotation axis by a corresponding actuator. The single tool holding devices are rotatably mounted and angularly spaced apart around the aforesaid rotation axis of the turret. By suitably rotating the latter, the tool holding device necessary for the machining operation can be selected and positioned at the ram.

In multi-tool heads with fixed head, in addition to being moved linearly along the work axis to drive the tool, the ram is rotated around the aforesaid work axis to select and drive the required tool.

The rotation of the punching tool around a respective axis for angular orientation (indexing) is achieved by rotating the tool holding device and the ram in a coordinated manner.

In this case as well, two distinct actuators are used to drive the ram linearly and in rotation, respectively, with constructive solutions substantially similar to those provided for a single-tool head provided with spindle.

A third actuator, typically a rotary electric motor, is moreover provided to rotate the tool holding device and angularly orient the tool.

In multi-tool heads with rotating head the ram has only a linear movement and the selection of the tool and the angular orientation thereof are achieved by rotating in a coordinated manner part of the head and the tool holding device.

A drawback of known multi-tool punching apparatus with a fixed or rotating head is that they require three distinct actuators in order to move the ram and select and angularly orient the punching tool. The three actuators and the respective motion transmission means are generally complex and involve considerable dimensions and high costs of the punching apparatus.

An object of the present invention is to improve the known punching apparatus, in particular multi-tool punching apparatus.

Another object is to provide a punching apparatus having a simple and compact structure, and reduced dimensions.

A further object is to produce a punching apparatus that enables the punching process to be carried out in an optimal manner and at the same time enables the punching tool to be selected and/or oriented angularly using a limited number of actuators.

In a first aspect of the invention there is provided a punching apparatus having a second rotating actuator including a second electric motor provided with a stator fixed to a containing means and a rotor that is internal and coaxial with the stator and connected to a beating element in such a way as to rotate with the beating element. The rotor extends along a work axis in such a way as to face, and be engaged with, the stator between operating positions to rotate around the work axis when the second electric motor is operated.

In a second aspect of the invention there is provided a punching apparatus having a beating element including an operative end provided with coupling means arranged for coupling with further coupling means of a tool holding unit so as to rotate the further coupling means around a respective rotation axis and enable a punching tool to be angularly oriented.

The invention can be better understood and implemented with reference to the appended drawings, which illustrate some non-limiting example embodiments of the invention, in which.

Figure 1:
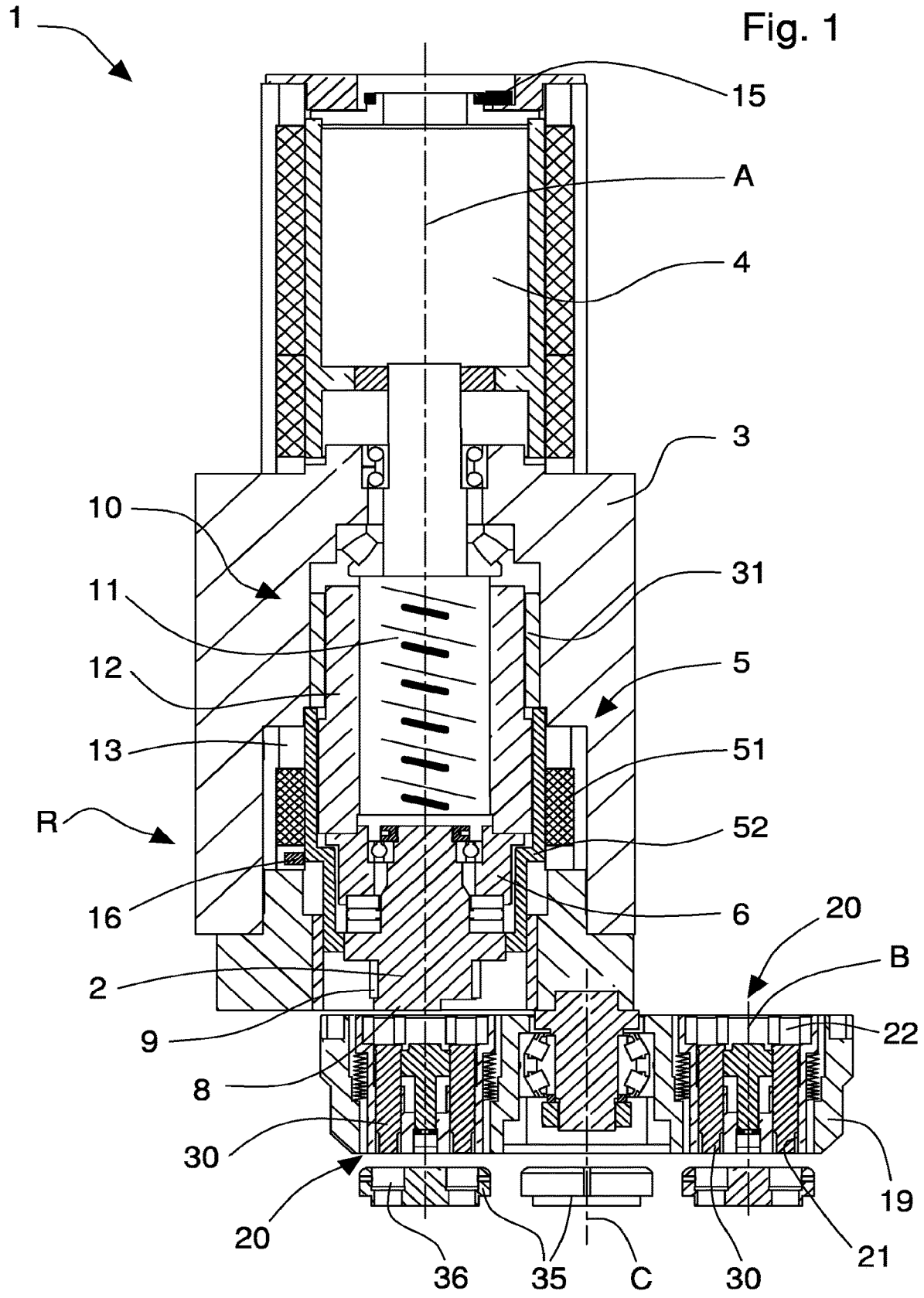
FIG. 1 is a longitudinal section view of the punching apparatus of the invention wherein a beating element is in an internal operating position.
Figure 2:
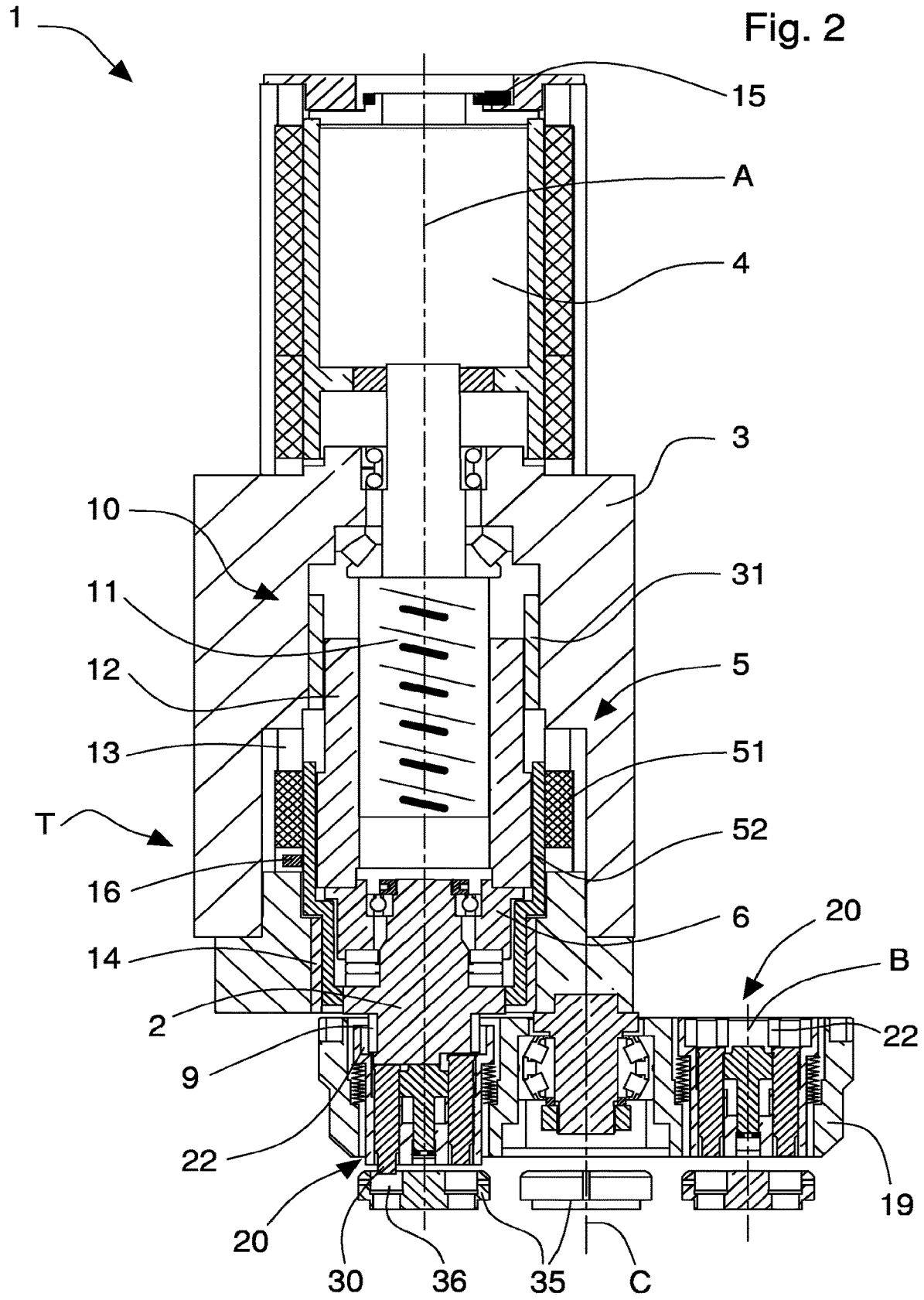
FIG. 2 is a longitudinal section view of the apparatus wherein the beating element is in an external operating position.
Figure 3:
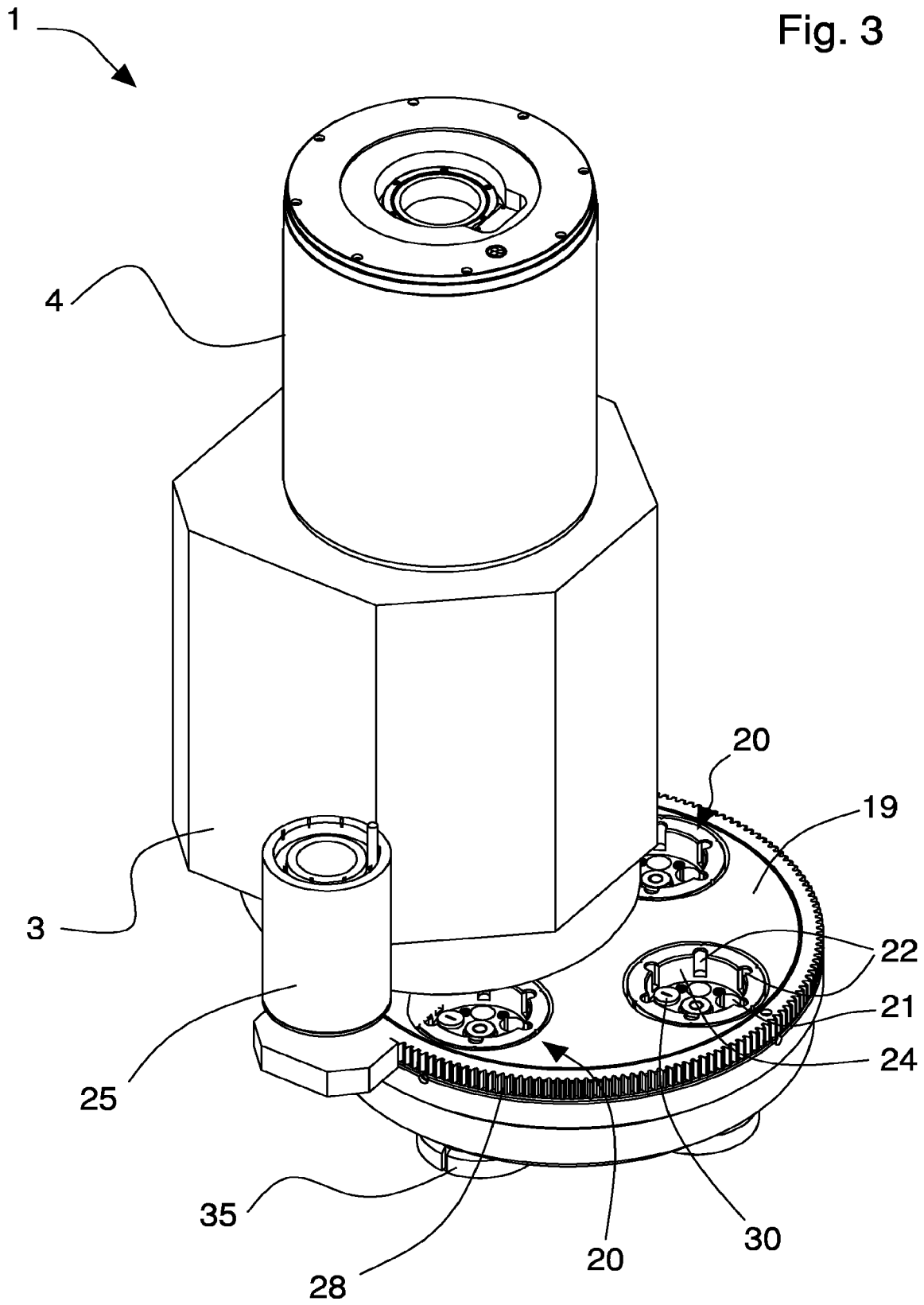
FIG. 3 is a perspective view of the punching apparatus of FIG. 1.
Figure 4:
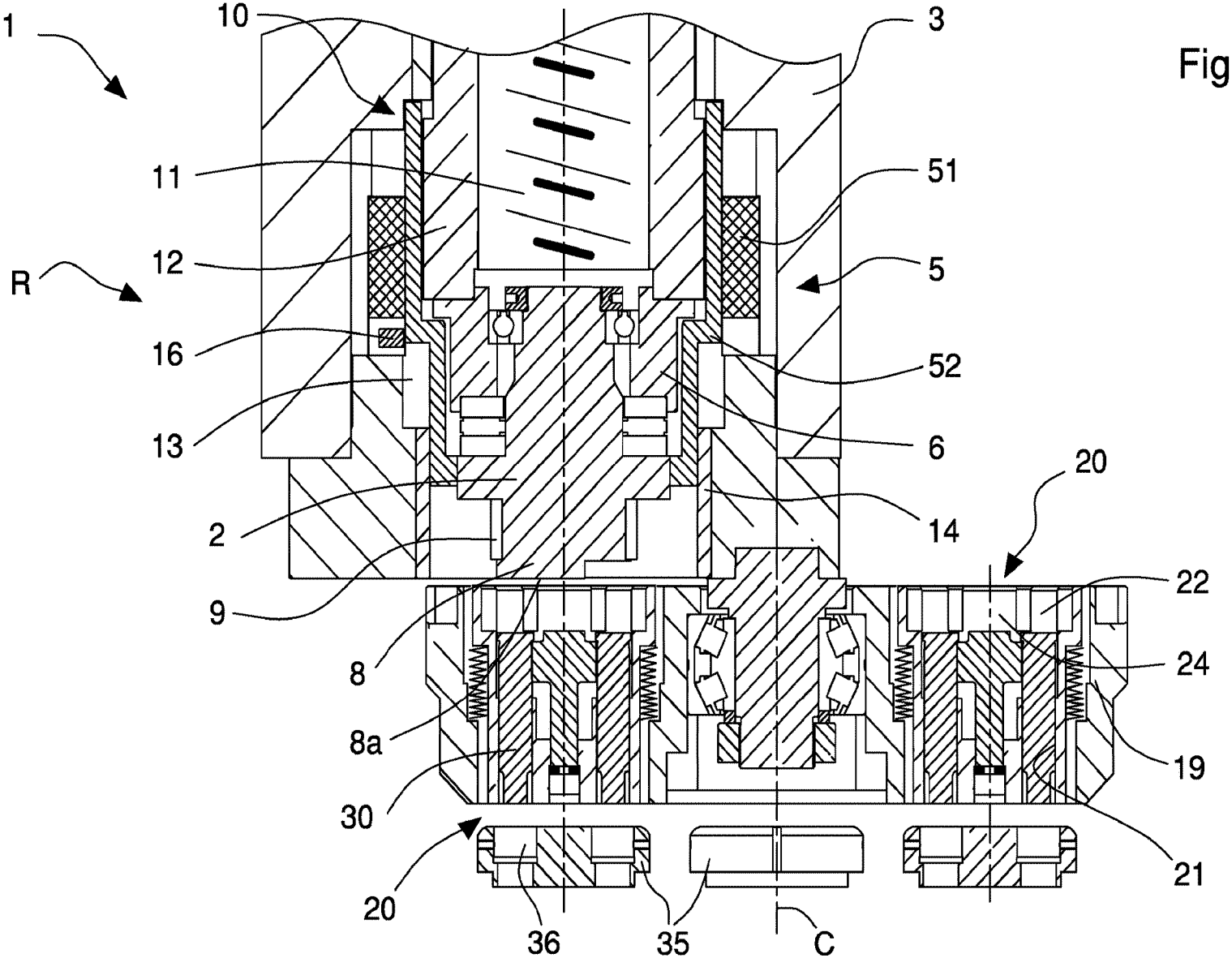
FIG. 4 is a partial, enlarged section view of the apparatus of FIG. 1 which shows, in particular, tool holding turret means and tool holding unit.

With reference to FIGS. 1 to 4, the punching apparatus 1 of the invention is shown that is associable with a punching machine tool, of a known type and not illustrated, suitable for performing cutting and/or punching operations on workpieces, in particular sheet metal. The punching apparatus 1, conventionally also called punch head, comprises a beating element 2, so called ram, arranged for interacting with a punching tool 30, so called punch, and movable inside containing means 3 along and around a work axis A. In particular, in the illustrated embodiment the beating element 2 is separate from the punching tool and during operation beats and progressively pushes and moves the punching tool against the workpiece to be machined.

The apparatus 1 comprises a first rotating actuator 4 coupled by transmission means 10 to the beating element 2 for moving the latter linearly along the work axis A and driving the punching tool 30. The beating element 2 and the punching tool 30 associated with it are thus moved along a working stroke in both directions, said stroke having a length that depends on the thickness of the workpiece to be machined. In particular, the beating element 2 is moved between an internal operating position R (FIG. 1), wherein it is inside the containing means 3 and spaced and disengaged from the punching tool 30, and an external operating position T (FIG. 2), wherein said beating element 2 pushes the punching tool 30 into its position of maximum external extension.

The apparatus 1 further comprises a second rotating actuator 5 connected to the beating element 2 and arranged for rotating the latter around the work axis A, in particular for angularly orienting the punching tool 30.

The containing means 3 comprises a box-type support and containment structure provided with a cavity 13 suitable for housing the beating element 3, the transmission means 10 and the second rotating actuator 5. The containing means 3 enables the apparatus 1 to be fixed to a supporting frame of the punching machine. The latter comprises a work table intended to support the workpiece and on which at least one die or counterpunch is fixed that cooperates with the punching tool 30 for performing machining operations on the workpiece.

The first rotating actuator comprises a first motor, in particular a first electric motor 4, which is fixed to the containing means 3 and provided with a drive shaft that is coaxial with the work axis A and connected to the transmission means 10. In particular, the first electric motor 4 is fixed externally to the containing means 3, substantially aligned with the work axis A and on the opposite side with respect to the beating element 2.

The first electric motor 4 comprises, for example, a torque motor or a brushless motor.

The first rotating actuator can also comprise a hydraulic or pneumatic motor.

The transmission means 10 comprises screw means 11 rotatably supported by the containing means 3 and rotated by the first rotating actuator 4 and nut screw means 12 engaged with the screw means 11 and connected to the beating element 2; nut screw means 12 is moved and translated along the work axis A when the screw means 11 is rotated.

In the illustrated embodiment, screw means comprises a recirculating ball screw 11 inserted inside the cavity 13 of the containing means 3 and rotatably supported by a couple of bearings. The screw 11 is connected to the drive shaft of the first electric motor 4.

Nut screw means comprises a nut screw or female screw 12 engaged with the screw 11 and sliding inside the cavity 13. Anti-rotation means 31 is provided to prevent nut screw 12 rotating during rotation of the screw 11. Anti-rotation means comprises, for example, one or more splines.

The beating element 2 is rotatably fixed by means of a joining element 6 to the end of the nut screw 12 that is opposite the first electric motor 4.

The second rotating actuator comprises a second electric motor 5 provided with a stator 51 fixed to the containing means 3 and an rotor 52 that is internal and coaxial with the stator 51 and connected to the beating element 2 in such a way as to be movable with the latter. The stator 51 comprises a respective cylindrically shaped tubular element fixed to an internal wall of the cavity 13 and such as to envelop and surround the rotor 52, the beating element 2 and transmission means 10.

The rotor 52 extends along the work axis A in such a way as to always face, and be engaged with, the stator 51 along the working stroke and to rotate around the aforesaid work axis A when the second electric motor 5 is actuated. In particular, the rotor 52 comprises a shaped tubular element which partially wraps the beating element 2 and the nut screw 12 and extends longitudinally in the direction of the work axis A, with a length such as to ensure that in any position of the beating element 2 between the internal operating position R and the external operating position T, the stator 51 always faces a portion of the rotor 52 so that the respective magnetic fields can interact, thus ensuring the operation of the second electric motor 5. In particular, shape and size of the rotor 52 assure that the interaction of the magnetic fields always carry out a desired machine torque of the electric motor.

The second electric motor 5 comprises, for example, a torque motor or a brushless motor.

The apparatus includes a bushing means 14 fixed to an internal wall of the cavity 13 and intended to engage with and slidably support the rotor 52.

The beating element 2 is provided with an operative end 8 suitable for interacting with the punching tool 30.

The apparatus comprises sensor means 15, 16 arranged for detecting rotations and/or linear movements of the beating element 2 and control means connected to sensor means 15, 16 in order to drive in a coordinated and/or interpolated manner the first rotating actuator 4 and the second rotating actuator 5, as better explained further below in the description.

The sensor means comprises in particular first sensor means 15 for measuring at least angular speed and position of the first rotating actuator 4, and second sensor means 16 for measuring at least a rotation of the beating element 2.

The first sensor means 15 comprises an angular position transducer or encoder directly mounted on, for example integrated with, the first electric motor 4. Once the transmission ratio (rotation-linear movement) of the transmission means 10 is known, control means can in fact calculate the linear movement and speed of the beating element 2 from the angular speed and position of the first rotating actuator 4.

The second sensor means 16 comprises an angular position transducer or encoder comprising a first measuring element (measuring head) fixed to the containing means and a second measuring element (graduated ring) fixed to the beating element 2.

It is worth observing that thanks to the embodiment of the second rotating actuator 5 comprising a rotor 52 which is fixed to, and movable with, the beating element 2 and directly driven by the stator 51, it is possible to obtain a punching apparatus (punch head) that is particularly compact, with reduced overall dimensions. In particular, the stator 51 and the rotor 52 are coaxial with the work axis A and have transverse dimensions, relative to the work axis A, substantially corresponding to those of the transmission means 10.

It should be noted, moreover, that unlike known apparatus, transmission means such as gears, timing belts or the like are not necessary to transmit the rotation of the second electric motor to the beating element 2. The structure of the punching apparatus 1 of the invention is therefore considerably simplified, more efficient, reliable and economical.

The punching apparatus 1 of the invention is also compact and structurally simpler due to the fact that the first electric motor 4 is mounted externally to the containing means 3, coaxially with the work axis A and directly connected to the screw 11, in the case it comprises a torque motor, or else by the interposition of reduction gear means.

With the described arrangement of the actuators it is moreover possible to carry out machining operations requiring interpolated motions of the two actuators 4 and 5, i.e. rotational-translational movements of the beating element 2, for example threads.

In the embodiment illustrated in FIGS. 1 to 4, the punching apparatus 1 of the invention is of the multi-tool type and comprises a tool holding turret 19 rotatably connected to, and supported by, containing means 3 and supporting a plurality of tool holding units 20, for example four, angularly spaced and rotatably mounted around respective rotation axes B. The tool holding turret 19 is rotatable around a selection axis C to position a set tool holding unit 20 facing the beating element 2.

The apparatus comprises a third rotating actuator 25 for rotating the tool holding turret 19 around said selection axis C by further transmission means 28. The latter comprises, for example, a ring gear 28 mounted peripherally on the turret 19 and engaged by a pinion, not illustrated, of the third rotating actuator 25.

Each tool holding unit 20 is provided with a plurality of seats 21 for slidably housing respective punching tools 30. The tool holding unit 20 is mounted on the turret 19 rotatable around a respective rotation axis B for allowing a set punching tool 30 to be angularly oriented, as better explained further below in the description. In the illustrated embodiment, each tool holding unit comprises eight seats 21 arranged for receiving respective punching tools 30.

The operative end 8 of the beating element 2 is provided with a beating portion 8*a* arranged for abutting on one set punching tool 30 only, said set punching tool 30 being selected and engaged by suitably rotating the beating element 2 around the work axis A. More precisely, by actuating the second electric motor 5 it is possible to rotate the beating element 2 by a predefined angle, detected by second sensor means 16, in such a way as to position the beating element 2 with the beating portion 8*a* arranged for engaging with and abutting on the set punching tool 30.

The operative end 8 of the beating element 2 is moreover provided with coupling means 9 suitable for coupling with further coupling means 22 of the tool holding unit 20 so as to rotate the latter around the respective rotation axis B. The coupling means comprises one or more projections or teeth 9 radially arranged on an outer cylindrical wall of the beating element 2 and capable of being inserted into and engaging with corresponding grooves 22 of the further coupling means. The grooves 22 are carried out on a cylindrical inner wall of a housing 24 of the tool holding unit 20 which is suitable for receiving the operative end 8 of the beating element 2. The teeth 9 and the grooves 22 have a complementary shape.

The apparatus 1 of the invention further comprises a plurality of multi-die units 35, each of which is provided with a plurality of dies or counterpunches 36 designed to cooperate with respective punching tools 30 in order to perform cutting and/or punching operations on the workpieces to be machined. Each multi-die unit 35 can rotate with the respective tool holding units 20 around the corresponding rotation axis B to enable the angular orientation of the punching tool 30. Similarly, the multi-die unit 35 can rotate with the tool holding turret 19 around the selection axis C. The multi-die units 35 are associated with the work table of the punching machine.

The operation of the punching apparatus 1 of the invention comprises a first, initial operating step of setting or adjustment, wherein the tool holding unit 20 to be used is selected by rotating the tool holding turret 19 around the selection axis C in such a way as to bring a desired tool holding unit 20 near the beating element 2. The latter is arranged in the internal operating position R, in which it is spaced from the tool holding unit 20 (FIG. 1). During the rotation of the tool holding turret 19, or at the end of that rotation, the beating element 2 is rotated around the work axis A in such a way as to engage a set punching tool 30 in the tool holding unit with the beating portion 8*a* in the subsequent working stroke.

The control means of the apparatus and the second sensor means 16 enable the second electric motor 5 to be actuated in such a way as to control with precision the rotation of the beating element 2.

In a second operating step, the beating element 2 is moved by the first electric motor 4 by transmission means 10 along the work axis A into an intermediate operating position so that the operative end 8 is inserted in the housing 24 of the tool holding unit 20, the beating portion 8*a* abuts on or faces an interface end of the selected work tool, and the teeth 9 engage the grooves 22. In this intermediate operating position, the beating element 2, by rotating around the work axis A, causes the rotation of the tool holding unit 20 around the respective rotation axis B, the latter being substantially aligned and coaxial with the work axis A. In this manner it is possible, by actuating the second electric motor 5, to angularly orient the punching tool according to specific machining needs.

In a third operating step, the beating element 2 can be moved rapidly into the external operating position T so as to drive the punching tool 30, which can act upon the workpiece to be machined and perform the required punching operation in cooperation with the die 32 below.

Thanks to the punching apparatus 1 of the invention it is thus possible to use the rotation of the beating element 2 both to select a set punching tool 30 housed in the tool holding unit 20 and to angularly orient the latter in order to perform the required punching operation. The coupling means 9, 22 enables in fact the operative end 8 of the beating element 2 to rotate the tool holding unit 20. It is thus possible to use a single rotating actuator (the second electric motor 5) to perform two operations which in prior art punching apparatuses require two respective actuators. This technical solution allows reducing weight, dimensions and overall cost of the apparatus.

In a version of the punching apparatus 1 of the invention that is not illustrated in the figures, it is provided that the tool holding unit 20 mounted on the tool holding turret 19 supports a single punching tool 30. In this case, the rotation of the beating element 2 allows rotating the tool holding unit 20 only in order to angularly orient the punching tool.

The invention claimed is:

1. A punching apparatus comprising:

a containing element;

at least one punching tool;

a transmission system;

a beating element that is arranged for interacting with said punching tool and is movable inside said containing element along and about a work axis;

a first rotating actuator that is coupled by said transmission system to said beating element for moving said beating element linearly along the work axis between an internal operating position and an external operating position and driving said punching tool;

a second rotating actuator that is coupled to said beating element and arranged for rotating said beating element about the work axis; and at least one tool holding unit that is fixed to said containing element, is rotatable about a respective rotation axis, and comprises at least one seat for slidably housing said punching tool, wherein said beating element is rotatably connected to said transmission system and comprises an operative end provided with coupling elements, wherein said tool holding unit further comprises further coupling elements, and wherein said coupling elements are arranged for coupling with said further coupling elements so as to rotate said tool holding unit about the respective rotation axis and enable said punching tool to be angularly oriented.

2. The apparatus according to claim 1, wherein said tool holding unit further comprises a housing having an inner wall, said beating element further comprises an outer wall, said further coupling elements comprise a plurality of grooves that are on said inner wall of said housing of said tool holding unit that is suitable for receiving said operative end of said beating element, said coupling elements comprise a plurality of projections that are radially arranged on said outer wall of said beating element to respectively enter and engage with said grooves of said further coupling elements, and said projections and said grooves have a complementary shape.

3. The apparatus according to claim 1, wherein said at least one punching tool is a plurality of punching tools, and said at least one seat of said tool holding unit is a plurality of seats, each of said plurality of seats being suitable for slidably housing one of said plurality of punching tools.

4. The apparatus according to claim 3, wherein said operative end is provided with a beating portion that is arranged for engaging with a set punching tool of said plurality of punching tools, and said set punching tool is selected and engaged by said beating portion by rotating said beating element about the work axis.

5. The apparatus according to 1, further comprising a tool holding turret that is connected to, and supported by, said containing element, wherein said at least one tool holding unit is a plurality of tool holding units, and said tool holding turret supports said plurality of tool holding units that are arranged angularly spaced and mounted on said tool holding turret and rotatable about respective rotation axes.

6. The apparatus according to claim 5, wherein said tool holding turret is rotatable about a selection axis for positioning a set tool holding unit of said plurality of tool holding units to face said beating element, and said tool holding turret is rotated by a third rotating actuator.

7. The apparatus according to claim 1, wherein said second rotating actuator comprises a second electric motor provided with a stator that is fixed to said containing element and a rotor that is internal and coaxial with said stator and connected to said beating element in such a way as to rotate with said beating element, and said rotor extends along the work axis in such a way as to face and be engaged with said stator between the internal operating position and the external operating position to rotate about the work axis when said second electric motor is operated.

8. The apparatus according to claim 7, wherein said first rotating actuator comprises a first electric motor fixed to said containing element and provided with a drive shaft that is coaxial with the work axis and connected to said transmission system, and at least one of said first electric motor or said second electric motor comprises a torque motor or a brushless motor.

9. The apparatus according to claim 1, further comprising:

sensors each for detecting at least one of rotations or linear movements of said beating element; and a control unit connected to said sensors to drive said first rotating actuator and said second rotating actuator in a coordinated or interpolated manner.

10. The apparatus according to claim 9, wherein said sensors comprise first sensors for measuring at least one of angular speed or angular position of said first rotating actuator, and second sensors for measuring at least a rotation of said beating element.

11. The apparatus according to claim 9, wherein said transmission system comprises a screw that is rotatably supported by said containing element and rotated by said first rotating actuator, and a nut screw that is engaged with said screw and connected to said beating element, said nut screw is moved along the work axis when said screw is rotated, and said beating element is rotatably connected to said nut screw.

12. The apparatus according to claim 1, wherein said first rotating actuator comprises a first electric motor fixed to said containing element and provided with a drive shaft that is coaxial with the work axis and connected to said transmission system.

13. The apparatus according to claim 1, wherein said transmission system comprises a screw that is rotatably supported by said containing element and rotated by said first rotating actuator, and a nut screw that is engaged with said screw and connected to said beating element, and said nut screw is moved along the work axis when said screw is rotated.

* * * * *